US008490672B2

(12) United States Patent
Dieckmann

(10) Patent No.: US 8,490,672 B2
(45) Date of Patent: Jul. 23, 2013

(54) FASTENING DEVICE

(75) Inventor: Martin Dieckmann, Mettingen (DE)

(73) Assignee: Schmitz-Werke GmbH + Co. KG, Mettingen (DE)

( * ) Notice: Subject to any disclaimer, the term of this patent is extended or adjusted under 35 U.S.C. 154(b) by 267 days.

(21) Appl. No.: 12/793,950

(22) Filed: Jun. 4, 2010

(65) Prior Publication Data

US 2010/0307694 A1 Dec. 9, 2010

(30) Foreign Application Priority Data

Jun. 4, 2009 (DE) ..... 10 2009 023 835

(51) Int. Cl.
*A47H 13/00* (2006.01)

(52) U.S. Cl.
USPC ..... 160/392; 160/382; 160/402

(58) Field of Classification Search
USPC ..... 160/22, 382–404, 66
See application file for complete search history.

(56) References Cited

U.S. PATENT DOCUMENTS

| | | | | | |
|---|---|---|---|---|---|
| 286,026 | A | * | 10/1883 | Lobdell | 160/403 |
| 536,933 | A | * | 4/1895 | Morpeth | 160/404 |
| 1,492,736 | A | * | 5/1924 | Metzger | 160/387 |
| 2,336,189 | A | * | 12/1943 | Price | 160/397 |
| 2,547,692 | A | * | 4/1951 | D Azzo | 160/45 |
| 2,966,206 | A | * | 12/1960 | Hartman | 160/402 |
| 3,604,073 | A | * | 9/1971 | Green | 24/265 C |
| 3,757,479 | A | * | 9/1973 | Martinez | 52/222 |
| 3,783,931 | A | * | 1/1974 | Assael | 160/327 |
| 3,788,216 | A | * | 1/1974 | Lambert | 101/127.1 |
| 3,822,734 | A | * | 7/1974 | Tombu | 160/383 |
| 3,987,835 | A | * | 10/1976 | Bloomfield | 160/392 |
| 4,170,810 | A | * | 10/1979 | Peleg | 24/462 |
| 4,189,880 | A | * | 2/1980 | Ballin | 52/202 |
| 4,799,299 | A | * | 1/1989 | Campbell | 24/462 |
| 4,947,561 | A | * | 8/1990 | Delacroix et al. | 38/102.91 |
| 4,991,640 | A | * | 2/1991 | Verkindt et al. | 160/368.1 |
| 5,722,723 | A | * | 3/1998 | Riley et al. | 297/228.13 |
| 6,802,357 | B2 | * | 10/2004 | Taylor et al. | 160/371 |
| 7,063,124 | B2 | * | 6/2006 | Walker et al. | 160/392 |
| 7,111,662 | B2 | * | 9/2006 | Lukos | 160/392 |
| 7,614,439 | B2 | * | 11/2009 | Lukos | 160/392 |
| 2006/0207731 | A1 | * | 9/2006 | Lukos | 160/392 |

FOREIGN PATENT DOCUMENTS

| | | | |
|---|---|---|---|
| AT | 008775 | | 12/2006 |
| DE | 202006007416 | U1 | 10/2006 |
| EP | 760045 | B1 | 3/1997 |
| FR | 29124596 | A1 | 8/2008 |
| WO | 9531621 | | 11/1995 |

* cited by examiner

*Primary Examiner* — Katherine Mitchell
*Assistant Examiner* — Johnnie A Shablack
(74) *Attorney, Agent, or Firm* — Browdy and Neimark, PLLC

(57) ABSTRACT

A device for fastening an awning fabric to a winding roller with a welt rail comprises two claw elements swingable against each other, which are transferable into a beyond-dead-center position for the fastening device to snap into and become jammed in the welt rail.

21 Claims, 5 Drawing Sheets

FASTENING DEVICE

FIELD OF THE INVENTION

The invention relates to a device for fastening a tarpaulin on a winding roller with a welt rail. The invention also relates to an awning fabric with such a fastening device and an awning.

BACKGROUND OF THE INVENTION

For fastening an awning fabric to a winding roller, there is normally envisaged a round welt arranged in a welt rail. Once the awning is mounted in place, replacing the awning fabric is not easily possible.

EP 0 760 045 B1 describes an awning fabric, which is to be connected to a winding roller with the aid of a flexible magnetic tape, the awning fabric being hooked into the welt groove of the winding roller by means of a hook-shaped magnetic profile tape. If the awning is moved out too far, it may happen with this solution that the hook becomes unhooked from the winding roller if the magnetic force is overcome. Moreover, this solution does not work with winding rollers made of aluminum or plastic.

SUMMARY OF THE INVENTION

The invention is therefore based on the object of improving a device for fastening an awning fabric to a winding roller with a welt rail, an awning fabric and an awning generally, especially in terms of the stability of the connection between the fabric and the roller.

Said object is achieved by the invention the core of which consists in forming a fastening device with two claw elements, the claw elements being swingably connected with each other for the fastening device to snap into and become jammed in the welt rail of a winding roller.

The connection of the claw elements preferably forms a joint, especially a knee lever joint, which can be transferred into a beyond-dead-centre position by swinging the two claw elements into a locking direction, the claw elements being snappable into the welt rail in a locking position as they move beyond the dead-centre. In this position, the fastening device cannot by itself disengage from the welt rail.

The fastening device is preferably designed as a one-part profile part, especially as a plastic profile part, the joint connecting the claw elements being formed by a flexible area. This allows low-cost production. Moreover, the length of the profile part is very easily adaptable to the relevant needs.

The use of a stiffer material for the claw elements in the areas, which are envisaged for abutting against the limiting edges of the welt rail, increases the stability and longevity of the fastening device.

A welt rim arranged on one of the claw elements facilitates the mounting of the awning fabric to the fastening device.

The awning according to the invention is equipped with a fastening device which is reversibly jammable in the welt rail. This allows an easy replacement of the awning fabric on the one hand and a secure fastening of the awning fabric to the winding roller on the other hand.

The fastening device according to the invention is—unlike the prior art—able to function with a plastic or aluminum winding roller which is known to be particularly light and corrosion-resistant.

The fastening device preferably closes off the welt rail in the jammed position tightly towards the outside. This prevents the ingress of water, especially rain water, into the welt rail.

An embodiment of the fastening device adapted to the outer contour of the winding roller facilitates the rolling-up of the awning fabric onto the winding roller.

Further advantages, features and details of the invention result from the description of an embodiment on the basis of the drawings attached.

DESCRIPTION OF THE PREFERRED EMBODIMENT

Figure 2:
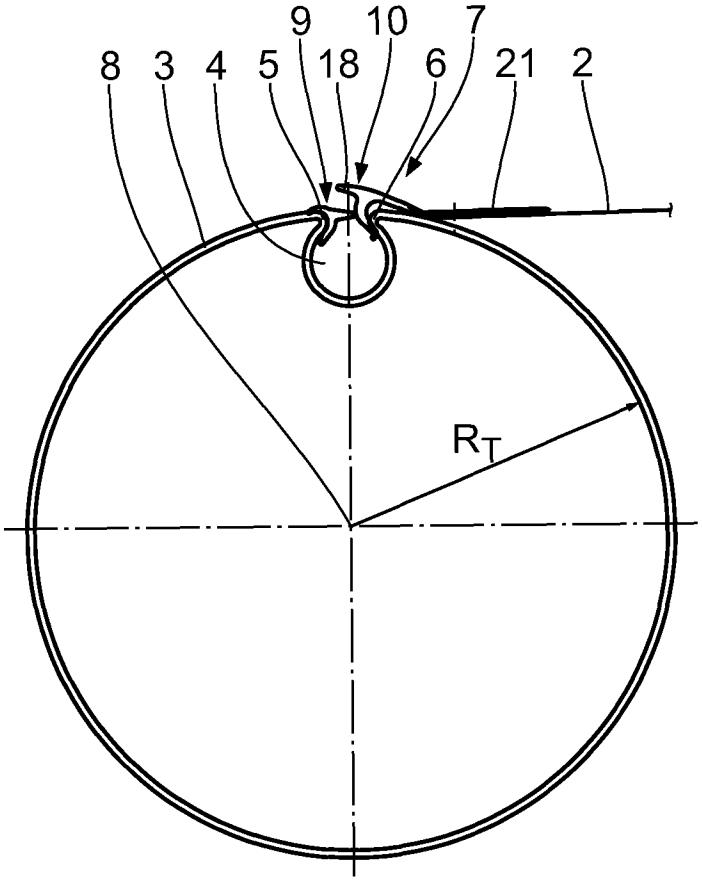
FIGS. 2 and 3 show views according to FIG. 1 during the insertion of the fastening device into the welt rail and in the inserted condition.
Figure 1:
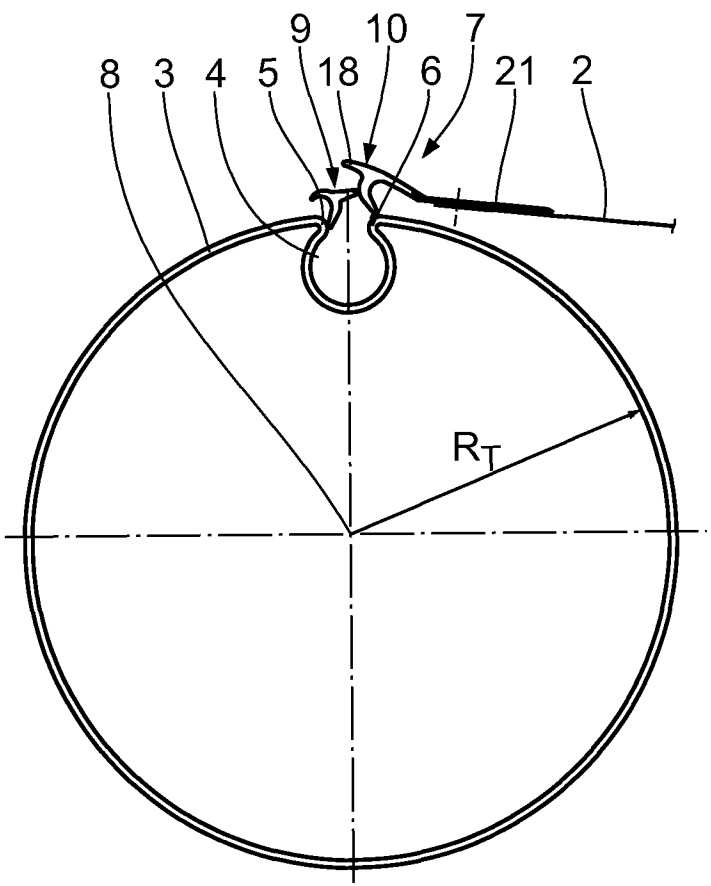
FIG. 1 shows a sectional representation of a winding roller with a fastening device according to the invention prior to jamming in the welt rail.
Figure 3:
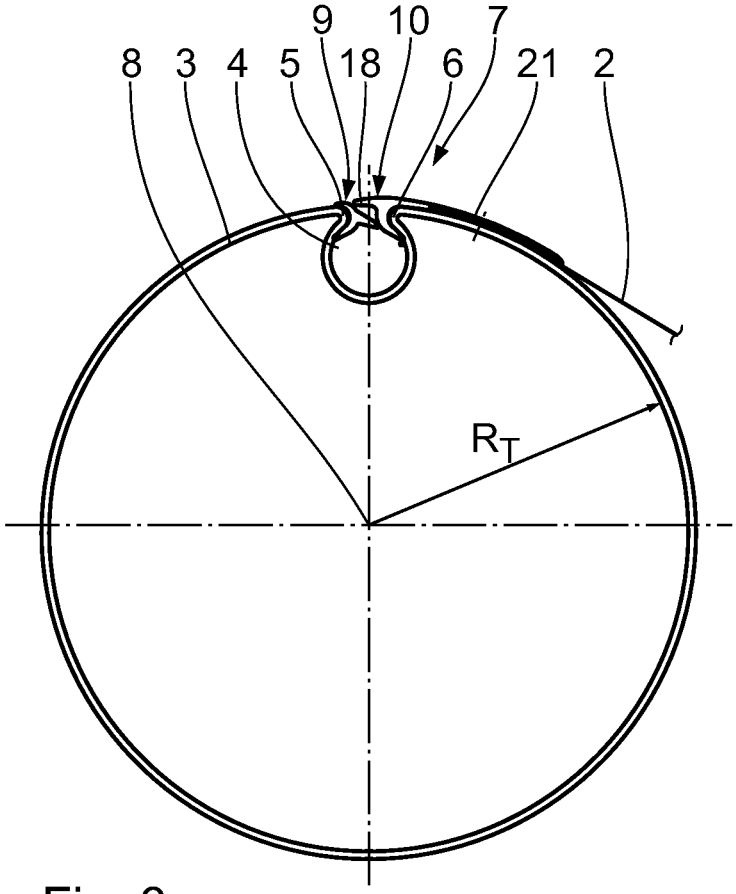
Figure 5:
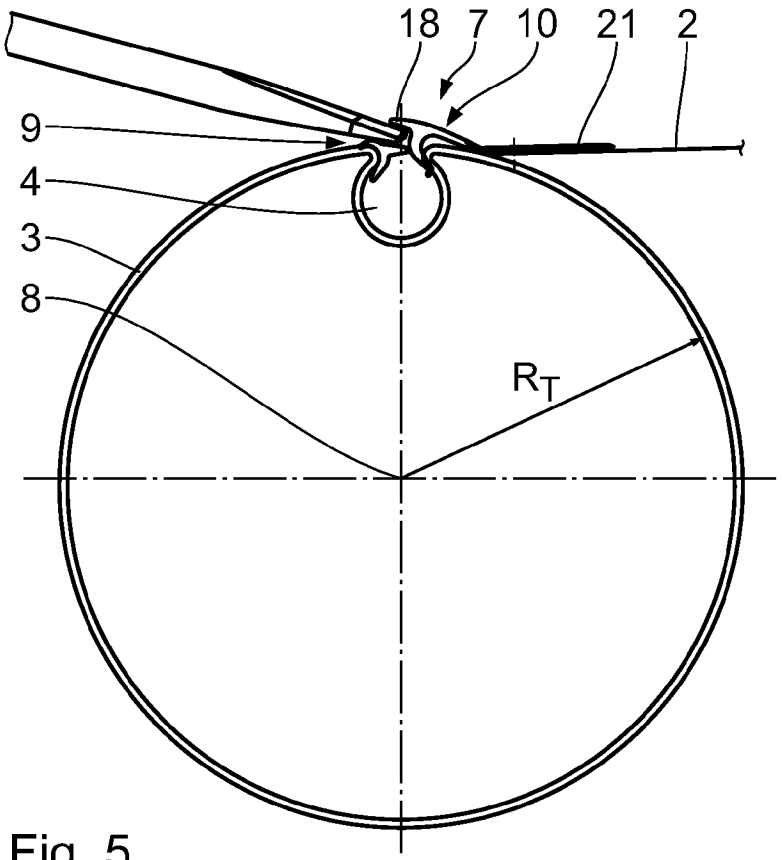
FIGS. 4 and 5 show views according to FIG. 3 to explain the disengaging process of the fastening device.
Figure 4:
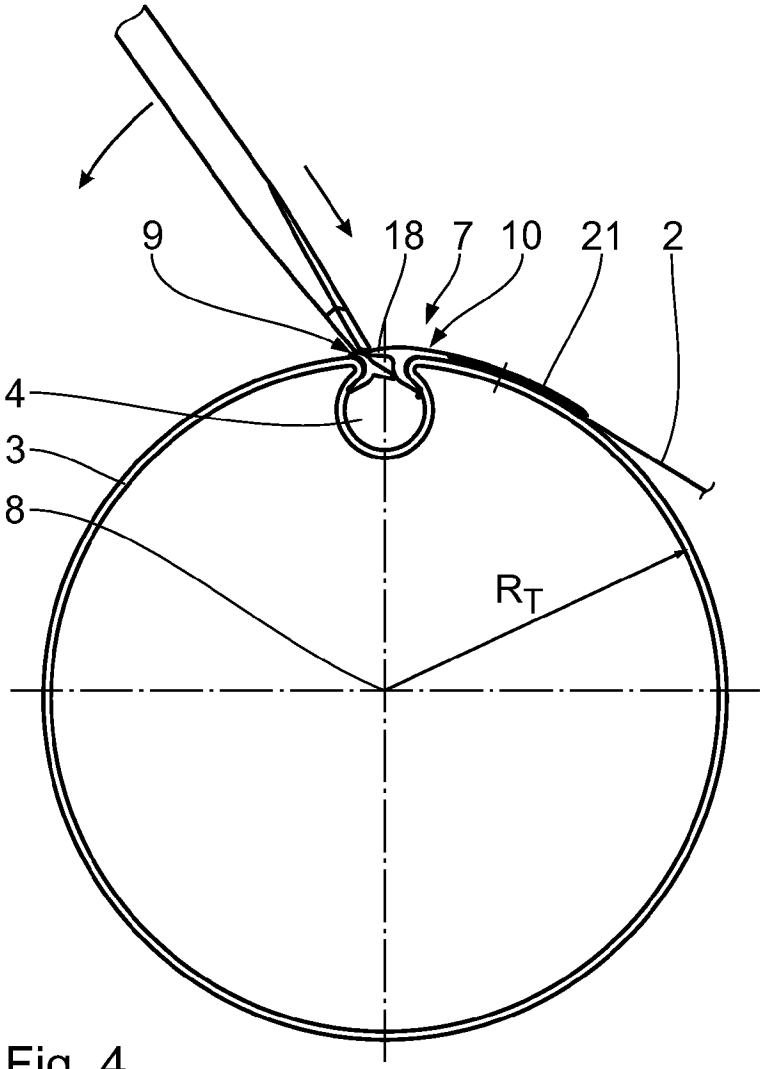

In the following, an embodiment of the invention is described with reference to FIGS. 1 to 7. An awning 1 according to the invention comprises an awning fabric 2 and a winding roller 3 for rolling up the awning fabric 2. The winding roller 3 extends in an axial direction along a longitudinal axis 8, around which it is rotatably disposed, and is hollow and made of a dimensionally stable material, preferably of aluminum or plastic.

The winding roller 3 exhibits a welt rail 4 with an essentially round cross-section. The welt rail 4 is designed as a groove running parallel to the longitudinal axis 8 with a first limiting edge 5 and a second limiting edge 6 lying opposite thereto. The limiting edges 5, 6 are rounded off to guard against the risk of injury. Aside from the welt rail 4, the winding roller 3 exhibits a round cross-section, especially a circular outer contour and a radius $R_T$.

In order to attach the awning fabric 2 to the winding roller 3, there is envisaged a fastening device 7. The fastening device 7 is reversibly jammable in the welt rail 4—as will be explained in the following in more detail.

In the following, the fastening device 7 is described in more detail. It comprises a first claw element 9 and a second claw element 10. The claw elements 9, 10 are swingably connected with each other for the fastening device 7 to snap into and become jammed in the welt rail 4 of a winding roller.

The fastening device 7 is designed as profile part, especially as a plastic profile part. It is preferably designed as a single part, the claw elements 9, 10 being connected with each other by a flexible area 11. For the formation of the flexible area 11, there are, for example, envisaged a soft plastic or the design of the area as a kind of film hinge. A multi-part design of the fastening device 7 is, however, also possible. It is especially conceivable that the claw elements 9, 10 are formed separately and connected with each other by means of a hinge.

Each of the claw elements 9, 10 exhibits an abutting area 12, each envisaged for abutting against one of the limiting edges 5, 6. The abutting area 12 is in each case formed in the shape of a bow and in each case exhibits two free ends 20. As the fastening device 7 is inserted into the welt rail 4, the free ends 20 come to lie on sides, which are in each case facing each other, of one of the limiting edges 5, 6. The abutting area 12 exhibits in each case an essentially circular arc-shaped section 13 with a radius of curvature r and a curvature centre $M_1$, $M_2$. In the abutting area 12 the claw elements 9, 10 are made of a stiffer material then in the flexible area 11. For the abutting area 12 a hard plastic is envisaged. The abutting area 12 is, in its shape, adapted to the design of limiting edges 5, 6. Thus, in the jammed condition, the fastening device 7 in the welt rail 4 abuts face-to-face against the winding roller 3, especially against the limiting edges 5, 6 thereof.

If one imagines a first connecting line 14 from the first curvature centre $M_1$ to the flexible area 11, and a second connecting line 15 from the second curvature centre $M_2$ to the flexible area 11, then the two connecting lines 14, 15 correspond to the levers of a knee lever joint, the flexible area 11 forming a joint axis 16. By swinging the claw elements 9, 10 about the joint axis 16, there can be changed an angle $\alpha$ enclosed by the connecting lines 14, 15. The claw elements 9, 10 are especially swingable such that the connecting lines 14, 15 are transferable into an overstretched position. An overstretched position here is to be understood as a position in which the connecting lines 14, 15 enclose an angle $\alpha$ of >180°. The claw elements 9, 10 are thus connected by means of a joint, which is transferable into a beyond-dead-centre position. This effects a secure snapping-in of the claw elements 9, 10 into the welt rail 4. This way, an unintended disengagement of the fastening device 7 out of the jammed position in the welt rail 4 is reliably avoided.

The first claw element 9 exhibits a lever extension 17 arranged essentially along the first connecting line 14. The lever extension 17 follows on from the abutting area 12 of the first claw element 9. On its second end facing the second claw element 10 the lever extension 17 comprises the flexible area 11. It is also conceivable to design the whole lever extension 17 to be flexible.

The second claw element 10 exhibits an extension 18, which forms a leverage for swinging the claw elements 9, 10. The extension 18 also forms a stop limiting the swingability of the claw elements 9, 10 against each other.

The extension 18 extends from the abutting area 12 of the second claw element 10 into the direction away from the second curvature centre $M_2$.

The second claw element 10 exhibits an outer contour 19 having a curvature, which is adapted to the radius $R_T$ of the winding roller 3. In the condition in which the fastening device 7 is inserted in the welt rail 4, the second claw element 10 covers the opening of the welt rail 4 with the extension 18 only just, so that the circular outer contour of the winding roller 3 is completed by the fastening device 7.

The second claw element 10 is connected with a welt rim 21. The welt rim 21 can advantageously be designed together with the second claw element 10 to form one single piece. It is preferably designed to be flexible. A soft plastic is especially envisaged as the material for the welt rim 21. However, it is also conceivable to make the welt rim 21 from a stiffer material, especially from a hard plastic. The welt rim 21 can especially be made from the same material as the abutting area 12. The welt rim 21 serves to attach the awning fabric 2 to the fastening device 7 and can be sewn, fused, glued or riveted to the awning fabric 2. Alternative attachment possibilities, e.g. by means of velcro fasteners, are also possible.

Especially in the case of a stiff design of the welt rim 21 is its shape adapted to the outer contour of the winding roller 3. It is preferably slightly bent, especially circular arc-shaped, the radius of curvature of the welt rim 21 corresponding to the radius $R_T$ of the winding roller 3.

The awning fabric 2 is preferably arranged on the concave side, i.e. the side of welt rim 21 facing the winding roller 3 in the condition in which the fastening device 7 is jammed in the welt rail 4. This way the hold of the awning fabric 2 is improved still further, as it is jammed in between the welt rim 21 and the winding roller 3.

Figure 6:
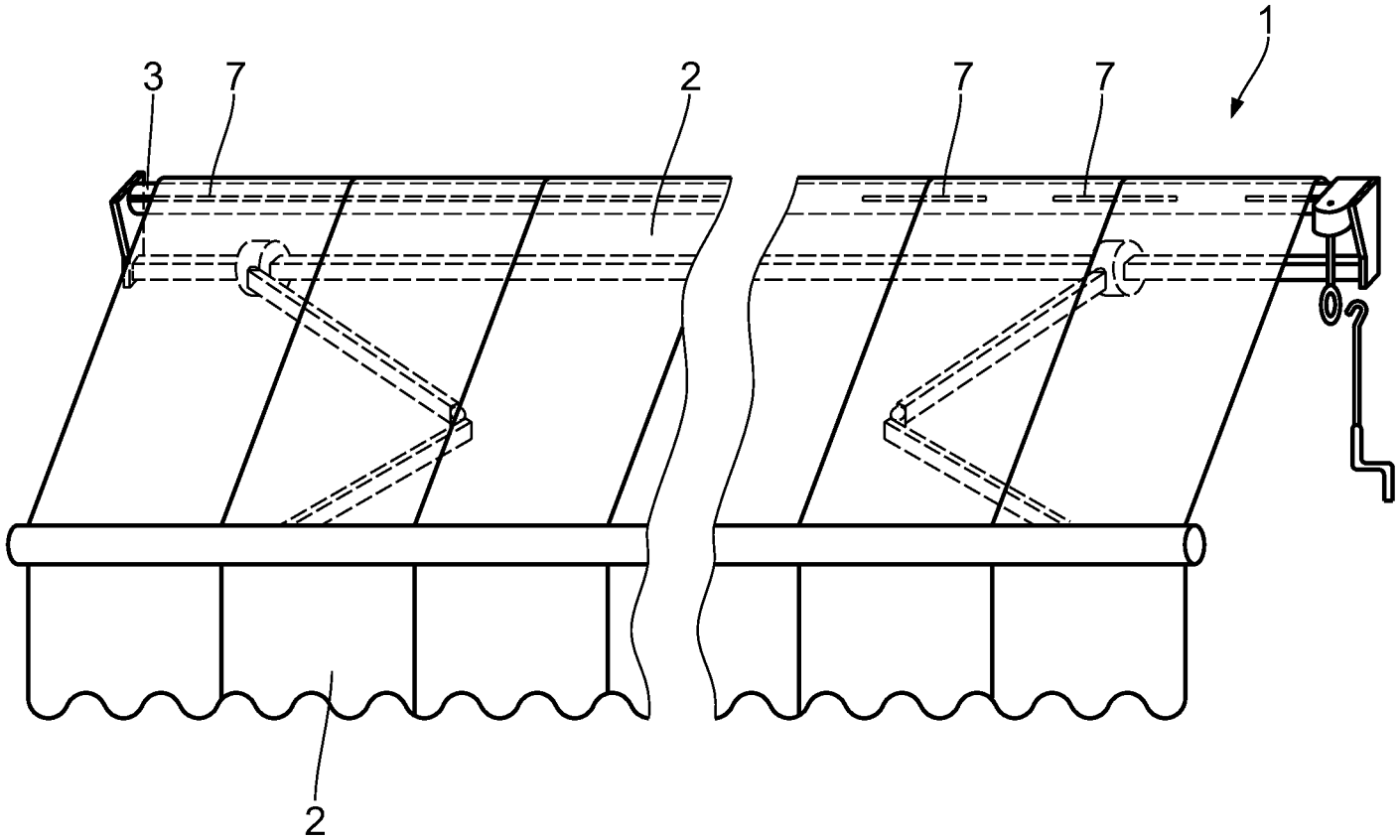
FIG. 6 shows a schematic representation of an awning and FIG. 7 shows an enlarged sectional representation of the fastening device according to FIG. 1.
Figure 7:
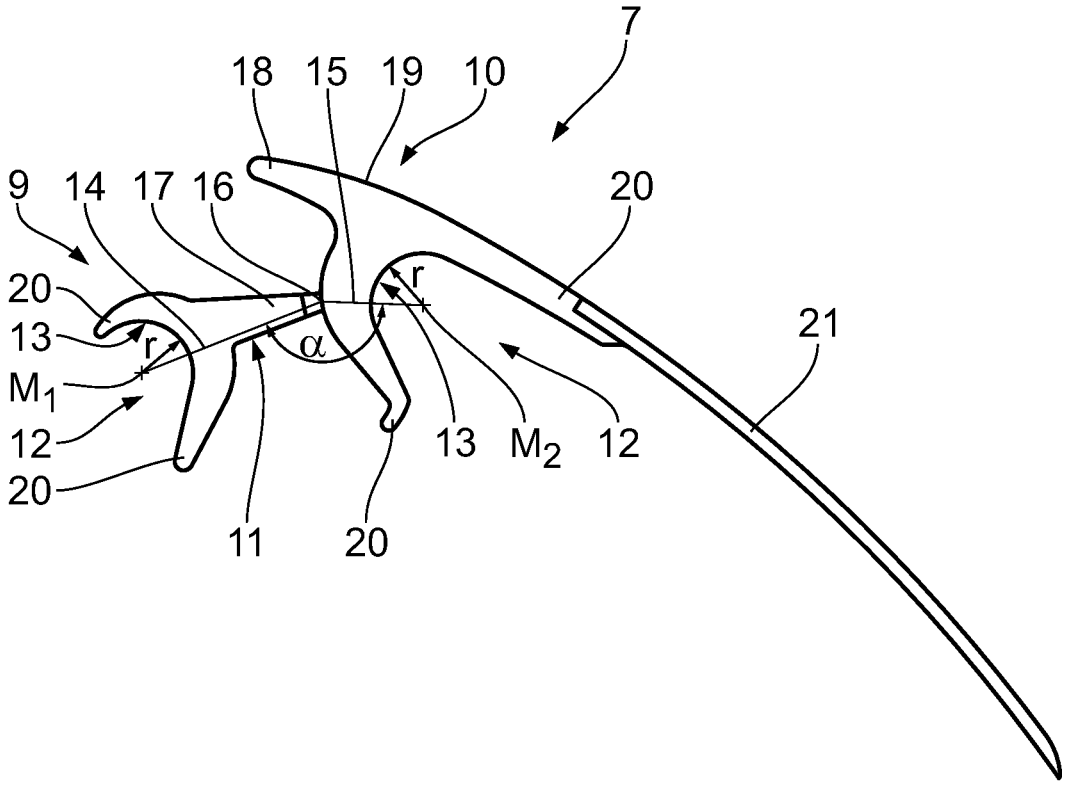

As shown in the left half of FIG. 6, the fastening device 7 may extend as a one-part profile part over the full length of the winding roller 3. As an alternative thereto it may be envisaged, as shown in the right half of FIG. 6, to fasten the awning fabric 2 to the winding roller 3 by means of a plurality of fastening devices 7, especially to jam it in the welt rail 4.

To fasten the awning fabric 2 to the winding roller 3, the fastening device 7 is inserted into the welt rail 4 such that the first claw element 9 engages with the first limiting edge 5 of the welt rail 4 and the second claw element 10 engages with the second limiting edge 6 of the welt rail 4. During this, especially the abutting areas 12 of the claw elements 9, 10 come to abut against the limiting edges 5, 6 of the welt rail 4. In this position, the angle $\alpha$, which is enclosed by the connecting lines 14, 15, is <180°. Through pressure on the extension 18 on the second claw element 10 in a direction radial to the longitudinal axis 8 towards the inside, the claw elements 9, 10 are pressed against the limiting edges 5, 6 and at the same time swung relative to each other. During this, the connection of the claw elements 9, 10, which forms a knee lever joint, is overstretched, which leads to a snapping-in of the fastening device 7. In other words, the claw elements 9, 10 are transferred inside the welt rail 4 into a beyond-dead-centre position. The swinging of the claw elements 9, 10 relative to each other is limited by the stop, which is formed by the extension 18. In the beyond-dead-centre position, the deformation of the flexible area 11, which is necessary for disengaging the fastening device 7, counteracts the disengagement of the fastening device 7. The fastening device 7 is thus secured against an autonomous disengaging from the welt rail 4.

In this condition, the fastening device 7 closes off the welt rail 4 water-tight towards the outside, and follows essentially the outer contour of the winding roller 3. The fastening device 7 only protrudes a few millimetres in the radial direction beyond the outer circumference of the winding roller 3. This enables an even, neat rolling-up of the awning fabric 2 onto the winding roller 3.

To disengage the fastening device 7, a lever, for example a screwdriver, is inserted between the extension 18 and the first claw element 9. Next, the second claw element 10 is levered, by means of the lever, out of the snapped-in position, against the force exercised by the flexible area 11, into the open position. During this, the first claw element 9, which abuts against the first limiting edge 5, forms a pivotal point, while the extension 18 forms a leverage for swinging the claw elements 9, 10. By means of the lever, there is thus exercised a force in the radial direction outwards with respect to the longitudinal axis 8 on the claw elements 9, 10, especially in the area of its connection, for disengaging the fastening device 7.

The fastening device 7 is thus easily and reversibly snappable into the welt rail 4 and again disengageable from the welt rail 4. In the snapped-in position, the fastening device 7 is especially secured against an unintended disengaging from the welt rail 4, even when the winding roller 3 is not stopped in time during the unrolling of the awning fabric 2. In this case, the awning fabric 2 is only rolled back onto the winding roller 3 in the opposite winding direction. The awning fabric is easily reversible by reversing the rotating direction of the winding roller 3.

The fastening device 7 according to the invention allows an easy substitution of the awning fabric 2 of an awning 1.

What is claimed is:

1. A device (7) for fastening a tarpaulin (2) to a winding roller (3) with a welt rail (4) comprising a first claw element (9) comprising an abutting area (12) having a curved shape and two free ends (20) between which is defined the abutting area for engaging with a first limiting edge (5) of the welt rail (4), a second claw element (10) comprising an abutting area (12) having a curved shape and two free ends (20) between which is defined the abutting area for engaging with a second, limiting edge (6) of the welt rail (4) lying opposite to the first limiting edge (5), the claw elements (9, 10) being swingably connected with each other for the fastening device (7) to snap into and become jammed in the welt rail (4), and wherein for connecting the claw elements (9, 10) there is envisaged a joint, which is transferable into a beyond-dead-centre position for the snapping-in of the claw elements (9, 10) into the welt rail (4), and wherein when the fastening device is inserted in the welt rail, the second claw element covers the opening of the welt rail with an extension that makes contact with the first claw element, so that the circular outer contour of the winding roller is completed by the fastening device.

2. A device (7) according to claim 1, wherein the tarpaulin (2) is an awning fabric.

3. A device according to claim 1, comprising a one-part design.

4. A device according to claim 1, wherein one of the claw elements (9, 10) is connected with a welt rim (21).

5. A device according to claim 1, wherein one of the claw elements (9, 10) exhibits an extension (18), which forms a leverage for swinging the claw elements (9, 10) against each other.

6. A device according to claim 1, wherein at least one of the claw elements (9, 10) exhibits a stop for limiting the swingability thereof, the stop being formed especially by the extension (18).

7. A device according to claim 1, wherein the device is designed as a profile part.

8. A device according to claim 1, wherein the device is designed as a plastic profile part.

9. An awning fabric (2), further comprising a fastening device (7) according to claim 1 for fastening an awning to a winding roller (3).

10. An awning (1) according to claim 1, wherein the second claw element exhibits an outer contour having a curvature equal to the curvature of the winding roller.

11. A device according to claim 1, wherein the claw elements (9, 10) are connected with each other by a flexible area (11).

12. A device according to claim 11, wherein in the area (12), which are envisaged for abutting against the limiting edges (5, 6) of the welt rail (4), the claw elements (9, 10) are each made of a stiffer material than in the flexible area (11).

13. An awning (1) comprising:

an awning fabric (2) and a winding roller (3) for rolling up the awning fabric (2), the winding roller (3) exhibiting a welt rail (4), wherein for the disengageable fastening to the winding roller (3), the awning fabric (2) is connected with a fastening device (7) reversibly jammable in the welt rail (4), the fastening device comprising:

a first claw element (9) comprising an abutting area (12) having a curved shape and two free ends (20) between which is defined the abutting area for engaging with a first limiting edge (5) of the welt rail (4), a second claw element (10) comprising an abutting area (12) having a curved shape and two free ends (20) between which is defined the abutting area for engaging with a second, limiting edge (6) of the welt rail (4) lying opposite to the first limiting edge (5), the claw elements (9, 10) being swingably connected with each other for the fastening device (7) to snap into and become jammed in the welt rail (4), wherein for connecting the claw elements (9, 10) there is envisaged a joint, which is transferable into a beyond-dead-centre position for the snapping-in of the claw elements (9, 10) into the welt rail (4), and wherein when the fastening device is inserted in the welt rail, the second claw element covers the opening of the welt rail with an extension that makes contact with the first claw element, so that the circular outer contour of the winding roller is completed by the fastening device.

14. An awning (1) according to claim 13, wherein the winding roller (3) is made from a non-magnetic material.

15. An awning (1) according to claim 13, wherein the winding roller (3) is made from one of the group of plastic and aluminium.

16. An awning (1) according to claim 13, wherein under the condition in which the awning is jammed in the welt rail (4), the fastening device (7) closes off the welt rail (4) tight towards the outside.

17. An awning (1) according to claim 13, wherein under the condition in which the awning is jammed in the welt rail (4), the fastening device (7) closes off the welt rail (4) water-tight towards the outside.

18. An awning (1) according to claim 13, wherein under the condition in which the awning is jammed in the welt rail (4), the fastening device (7) protrudes a maximum of 1 cm in the radial direction beyond the outer circumference of the winding roller (3).

19. An awning (1) according to claim 13, wherein under the condition in which the awning is jammed in the welt rail (4) the fastening device (7) protrudes a maximum of 5 mm in the radial direction beyond the outer circumference of the winding roller (3).

20. An awning (1) according to claim 13, wherein under the condition in which the awning is jammed in the welt rail (4) the fastening device (7) protrudes a maximum of 3 mm in the radial direction beyond the outer circumference of the winding roller (3).

21. An awning (1) according to claim 13, wherein the second claw element exhibits an outer contour having a curvature equal to the curvature of the winding roller.

* * * * *